US011118755B2

(12) United States Patent
Hong et al.

(10) Patent No.: US 11,118,755 B2
(45) Date of Patent: Sep. 14, 2021

(54) OUTDOOR LIGHTING FIXTURE

(71) Applicant: OPPLE LIGHTING CO., LTD., Shanghai (CN)

(72) Inventors: Mantang Hong, Shanghai (CN); Aiqin Huang, Shanghai (CN); Jianguo Li, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 47 days.

(21) Appl. No.: 16/358,651

(22) Filed: Mar. 19, 2019

(65) Prior Publication Data

US 2019/0211995 A1 Jul. 11, 2019

Related U.S. Application Data

(63) Continuation of application No. PCT/CN2017/097392, filed on Aug. 14, 2017.

(30) Foreign Application Priority Data

Sep. 20, 2016 (CN) ..... 201621066630.X

(51) Int. Cl.
*F21V 5/04* (2006.01)
*F21V 31/00* (2006.01)
(Continued)

(52) U.S. Cl.
CPC ..... *F21V 5/04* (2013.01); *F21K 9/69* (2016.08); *F21V 15/01* (2013.01); *F21V 23/005* (2013.01); *F21V 27/02* (2013.01); *F21V 31/005* (2013.01); *F21V 17/12* (2013.01); *F21W 2131/10* (2013.01); *F21Y 2103/33* (2016.08); *F21Y 2105/18* (2016.08); *F21Y 2115/10* (2016.08)

(58) Field of Classification Search
CPC ..... F21Y 2105/18; F21Y 2103/33; F21V 31/005; F21V 5/04; F21V 5/43; F21V 5/45
See application file for complete search history.

(56) References Cited

U.S. PATENT DOCUMENTS 10,914,452 B2 * 2/2021 Zou ..... G02B 19/0047
10,982,835 B2 * 4/2021 Shima ..... F21V 5/007
(Continued)

FOREIGN PATENT DOCUMENTS

CN 203810097 U 9/2014
CN 105202482 A 12/2015
(Continued)

OTHER PUBLICATIONS

International Search Report (including English translation) and Written Opinion issued in PCT/CN2017/097392, dated Nov. 16, 2017, 11 pages.

*Primary Examiner* — Andrew J Coughlin
(74) *Attorney, Agent, or Firm* — Arch & Lake LLP

(57) ABSTRACT

The present disclosure provides an outdoor lighting fixture, and a light body of the outdoor lighting fixture includes: a light-emitting component and a front cover, where the front cover includes a front cover housing and an annular lens, and the annular lens is provided with a light entry extremity attached to the light-emitting component, and a light exit extremity coupled with the front cover housing.

15 Claims, 4 Drawing Sheets

(51) Int. Cl.

| | |
|---|---|
| ***F21V 23/00*** | (2015.01) |
| ***F21V 15/01*** | (2006.01) |
| ***F21K 9/69*** | (2016.01) |
| ***F21V 27/02*** | (2006.01) |
| *F21W 131/10* | (2006.01) |
| *F21Y 115/10* | (2016.01) |
| *F21Y 105/18* | (2016.01) |
| *F21V 17/12* | (2006.01) |
| *F21Y 103/33* | (2016.01) |

(56) References Cited

U.S. PATENT DOCUMENTS

| | | | | |
|---|---|---|---|---|
| 2013/0265752 | A1* | 10/2013 | Shimizu | F21V 5/045 362/231 |
| 2014/0160772 | A1 | 6/2014 | Wu | |
| 2015/0128409 | A1* | 5/2015 | Chen | F21V 27/02 29/829 |
| 2015/0167922 | A1* | 6/2015 | Casper | H05B 47/11 362/311.02 |
| 2015/0176823 | A1* | 6/2015 | Leshniak | F21V 5/08 362/235 |
| 2015/0184827 | A1* | 7/2015 | Lin | G02B 6/0001 362/311.02 |
| 2018/0058636 | A1* | 3/2018 | Wang | F21K 9/272 |
| 2018/0245771 | A1* | 8/2018 | Liu | F21V 5/043 |

FOREIGN PATENT DOCUMENTS

| | | | |
|---|---|---|---|
| CN | 105465669 | A | 4/2016 |
| CN | 105627171 | A | 6/2016 |
| CN | 206145452 | U | 5/2017 |

* cited by examiner

OUTDOOR LIGHTING FIXTURE

CROSS-REFERENCE TO RELATED APPLICATIONS

This application is based upon and claims the priority of PCT patent application No. PCT/CN2017/097392 filed on Aug. 14, 2017 which claims the priority of Chinese Patent Application No. 201621066630.X filed on Sep. 20, 2016, the entire content of all of which is hereby incorporated by reference herein for all purposes.

TECHNICAL FIELD

The present disclosure relates to a lighting field, and more particularly, to an outdoor lighting fixture.

BACKGROUND

Outdoor lighting fixtures are lighting fixtures for outdoors use, for example, parks, squares, roadsides, and outdoor advertising. Commonly used outdoor lighting fixtures may include lawn lamps, yard lamps, underwater lamps, spot lamps, buried lamps, flood lights, and the like. As compared with home furnishing lighting, outdoor lighting has characteristics of high power, high brightness, large volume, long service life, low maintenance cost, and so on.

SUMMARY

The present disclosure provides an outdoor lighting fixture and a method of manufacturing an outdoor light fixture.

According to one aspect of the present disclosure, an outdoor lighting fixture is provided. The outdoor lighting fixture may include a light body and the light body may include a light-emitting component and a front cover, where the front cover may include a front cover housing and an annular lens, and the annular lens has a light entry extremity adjacent to the light-emitting component and a light exit extremity adjacent to the front cover housing.

According to a second aspect of the present disclosure, a method of manufacturing an outdoor light is provided. The method may include providing a light body of the outdoor light fixture; providing a light-emitting component and a front cover included in the light body; providing a front cover housing and an annular lens, where the annular lens has a light entry extremity adjacent to the light-emitting component and a light exit extremity coupled with the front cover housing.

It is to be understood that both the foregoing general description and the following detailed description are exemplary and explanatory only and are not restrictive of the present disclosure.

BRIEF DESCRIPTION OF THE DRAWINGS

Those ordinarily skill in the art will clearly understand various other advantages and benefits, through reading the detailed description of preferred implementation modes hereinafter. The accompanying drawings are provided only for illustrating the preferred implementation modes, rather than limiting the present disclosure. Throughout the accompanying drawings, same reference signs usually denote same components. In the drawings.

DETAILED DESCRIPTION

Figure 1:
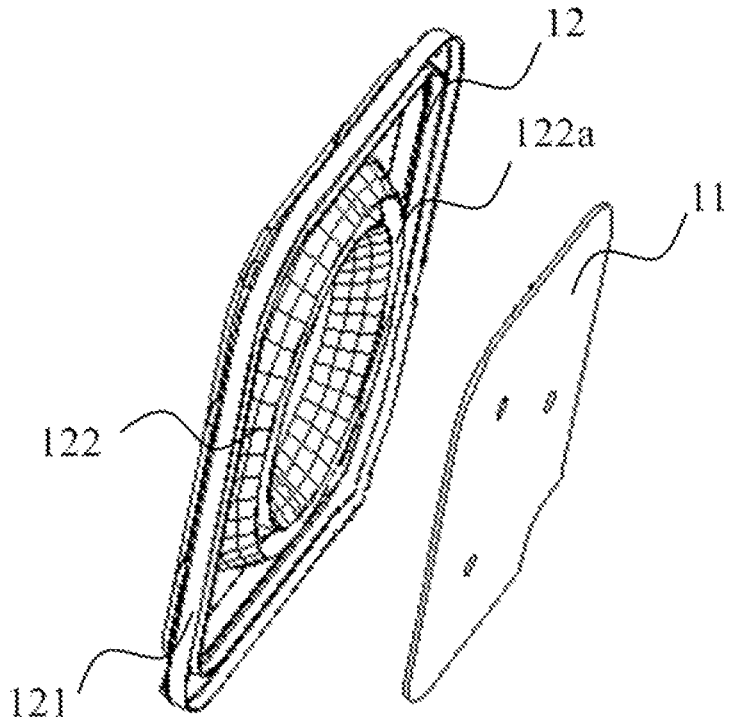
FIG. 1 illustrates a structural schematic diagram of a light body of an outdoor lighting fixture according to an example of the present disclosure.

Hereinafter, examples of the present disclosure will be described in more detail with reference to the accompanying drawings. Although the examples of the present disclosure are illustrated in the drawings, it should be understood that the present disclosure may be implemented in various forms and should not be limited by the examples explained here. On the contrary, these examples are provided so that the present disclosure may be understood more thoroughly, and the scope of the present disclosure may be completely conveyed to those skilled in the art.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The outdoor lighting fixture has a reflector used as a light distributing component, but employment of a reflector as a light distributing component causes problems of low light efficiency and uneven spot; in addition, the reflector is made of a metal material, for example, the reflector is formed by stamping an aluminum material, resulting in a higher production cost of the outdoor lighting fixture.

In order to solve the above-described technical problems, the present disclosure provides an outdoor lighting fixture. FIG. 1 illustrates a structural schematic diagram of a light body of an outdoor lighting fixture according to an example of the present disclosure. With reference to FIG. 1, a light body 1 of the outdoor lighting fixture comprises a light-emitting component 11 and a front cover 12, wherein, the front cover 12 comprises a front cover housing 121 and an annular lens 122, and the annular lens 122 has a light entry extremity 122*a* adjacent to the light-emitting component 11 and a light exit extremity coupled with the front cover housing 121.

The light body 1 of the outdoor lighting fixture according to the present disclosure comprises the front cover 12, and the front cover 12 comprises the annular lens 122 used as a light distributing component; in the present disclosure, the employment of the annular lens 122 as a light distributing component allows light passing through the annular lens 122 to have strong illumination and high brightness, thus solving the problem of low light efficiency where a reflector is used as a light distributing component.

In an example of the present disclosure, the light exit extremity of the annular lens 122 and the front cover housing 121 are located in a same plane and coupled with each other, or, the light exit extremity of the annular lens 122 and the front cover housing 121 are located in different planes and coupled with each other. In addition, the shape of a light casing of the outdoor lighting fixture provided by the present disclosure is square, so that light projection is more uniform.

In an example of the present disclosure, the front cover housing 121 and the annular lens 122 may be integrally molded components, and specifically, may be made of polymethyl methacrylate (PMMA), polycarbonate (PC), or glass. The front cover housing 121 and the annular lens 122 according to the present disclosure are fabricated by using an integral molding method, which reduces fabrication steps of the front cover 12, and further reduces production costs of the outdoor lighting fixture; in addition, the front cover housing 121 and the annular lens 122 are integrated, so that a structure of the outdoor lighting fixture is simplified, and more convenient for a mounting operation of the outdoor lighting fixture.

Figure 2:
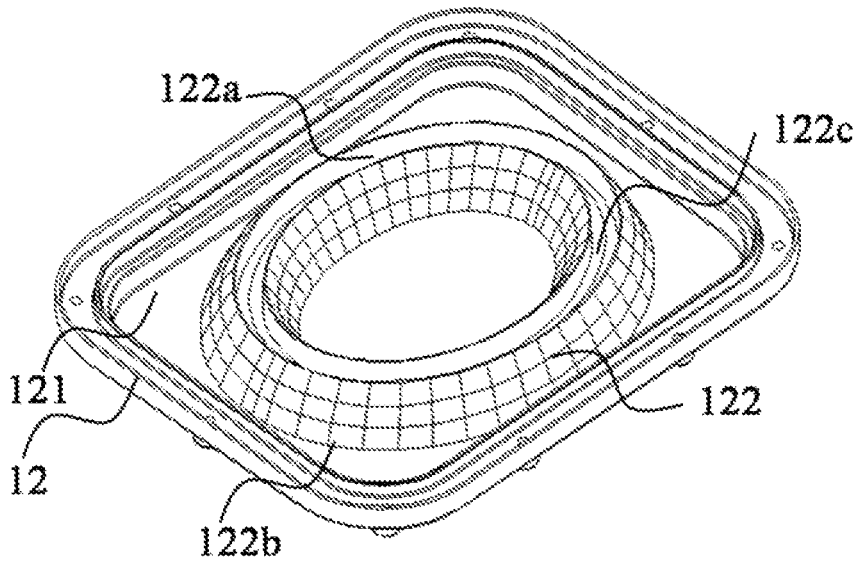
FIG. 2 illustrates a structural schematic diagram of a front cover according to an example of the present disclosure.

In an example of the present disclosure, with reference to FIG. 2, the front cover 12 comprises a front cover housing 121 and a annular lens 122, wherein, the annular lens 122 is provided with a light entry extremity 122*a* attached to the light-emitting component 11 and a light exit extremity 122*b* coupled with the front cover housing 121, the light entry extremity 122*a* is provided with a groove 122*c*, and the groove 122*c* is used for accommodating a light source in the light-emitting component 11. Since an LED light source has advantages of small volume, high brightness, low power consumption, long service life, and the like, in an example of the present disclosure, an LED light source is used as a light emitting element in the present disclosure. It should be added that, the LED light source is merely a preferred example of the present disclosure, and does not constitute any limitation on the present disclosure, and other light source, for example, a filament lamp, a power-saving lamp, and the like, may also be used.

Figure 3:
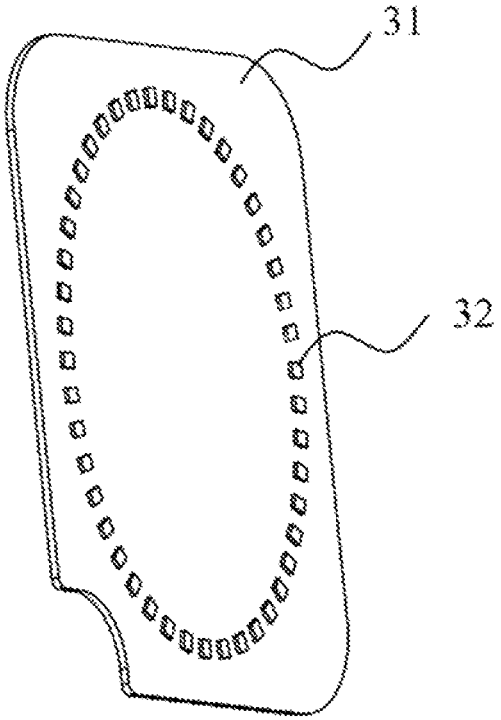
FIG. 3 illustrates a structural schematic diagram of a light-emitting component according to an example of the present disclosure.

FIG. 3 illustrates a structural schematic diagram of a light-emitting component according to an example of the present disclosure. With reference to FIG. 3, the light-emitting component 11 according to the present disclosure comprises a light source board 31, at least one LED chip 32, and an LED driving module (not illustrated). The LED chips 32 are arranged in an annular shape on the light source board 31; during a mounting process of the outdoor lighting fixture provided by the present disclosure, the LED chip 32 is located in the groove 122*c* provided at the light entry extremity 122*a* of the annular lens 122 illustrated in FIG. 2; in an example of the present disclosure, the annular lens 122 illustrated in FIG. 2 is in a shape of ellipsoid, the groove 122*c* provided at the light entry extremity 122*a* of the annular lens 122 is also in a shape of ellipsoid, and the LED chips 32 illustrated in FIG. 3 are distributed in the elliptical-shaped groove, and preferably, the LED chips 32 may be uniformly distributed in the elliptical-shaped groove.

The LED driving module is also provided on the light source board 31, wherein, the LED driving module may be provided on the light source board 31 to surround the LED chip 32, or, the LED driving module may be provided on a side of the light source board 31 where the LED chip 32 is not provided, or, a portion of the LED driving module is provided on one side of the light source board 31, and the other portion of the LED driving module is provided on the other side of the light source board 31. The LED driving module may convert a high-voltage alternating current into a low-voltage alternating current, and then convert the low-voltage alternating current into a low-voltage direct current through a bridge rectifier, then convert the low-voltage direct current into a constant current source through a DC/DC converter, and output a constant current to drive the LED chips 32.

Figure 4:
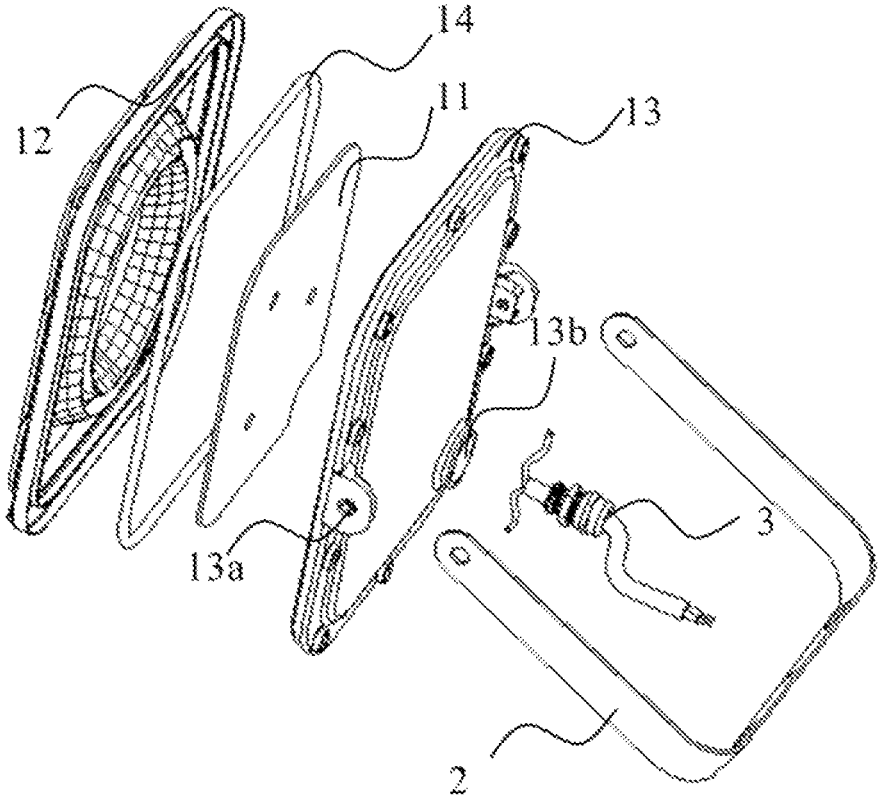
FIG. 4 illustrates another structural schematic diagram of a light body of an outdoor lighting fixture according to an example of the present disclosure.
Figure 5A:
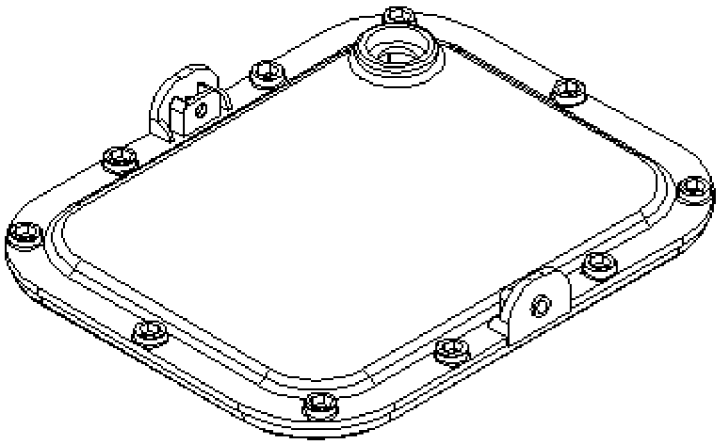
FIG. 5*a* illustrates a structural schematic diagram of a light body housing according to an example of the present disclosure.
Figure 5B:
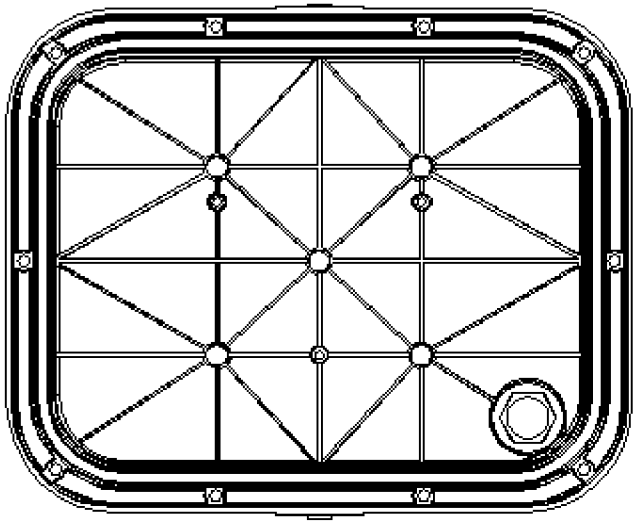
FIG. 5*b* illustrates a front view of the light body housing according to an example of the present disclosure.

FIG. 4 illustrates another structural schematic diagram of a light body of an outdoor lighting fixture according to an example of the present disclosure. With reference to FIG. 4, the light body 1 of the outdoor lighting fixture further comprises: a light body housing 13, wherein, the front cover housing 121 and the light body housing 13 are combined to form an enclosed cavity, the light-emitting component 11 and the annular lens 122 are both located in the enclosed cavity. FIG. 5*a* illustrates a structural schematic diagram of a light body housing according to an example of the present disclosure; and FIG. 5*b* illustrates a front view of the light body housing according to the example of the present disclosure. In the present disclosure, the front cover housing 121 and the light body housing 13 may be fixed together in a threaded fastening manner, for example, the front cover housing 121 and the light body housing 13 are fixed with a stainless steel screw.

With reference to FIG. 4, the light body of the outdoor lighting fixture further comprises: a sealing element 14, wherein, the sealing element 14 is provided at a position where the front cover housing 121 and the light body housing 13 are combined. In an example of the present disclosure, the sealing element 14 is a sealing ring. In order to facilitate mounting the sealing element 14, a groove for arranging the sealing element 14 is provided on the light body housing 13, so that in the mounting process, the sealing element 14 may be pressed into the groove provided on the light body housing 13. In the present disclosure, the groove for arranging the sealing element 14 may be further provided on the front cover housing 121, and in the case that the sealing element 14 is mounted, the sealing element 14 is pressed into the groove provided on the front cover housing 121. In the present disclosure, the front cover housing 121 and the light body housing 13 are fixedly combined together, and further the sealing element 14 is provided at the position where the front cover housing 121 and the light body housing 13 are combined, so that the light body of the outdoor lighting fixture provided by the present disclosure is waterproof.

In the present disclosure, the above-described light source board 31 illustrated in FIG. 3 may be fixed onto the light body housing 13, or, fixed onto the front cover housing 121.

In the present disclosure, in order to fixedly support the light body 1 of the outdoor lighting fixture provided by the present disclosure, with reference to FIG. 4, the light body of the outdoor lighting fixture further comprises a support 2 provided on the light body housing 13. In an example of the present disclosure, threaded holes 13*a* are provided on both sides of the light body housing 13, and both ends of the support 2 are screwed to the light body housing 13 through bolts and the threaded holes 13*a*. A shape of the support 2 illustrated in FIG. 4 is merely an example, and any other shape (for example, an arc-shaped) may be used, which will not be limited in the present disclosure.

In an example of the present disclosure, both sides of the light body housing 13 are provided with via holes in a direction perpendicular to a light projection direction of the outdoor lighting fixture, the via holes are used for closely arranging nuts; a size of the via hole is the same as an outline size of the nut placed therein, so that the nut is fixed in the via hole; and both ends of the support 2 are coupled to the light body housing 13 through bolts and the nuts; during a mounting process, the nut is fixed in the via hole before the nut and the bolt are assembled, and it neither rotates nor requires manual fixation, which eliminates fixation before bolt assembly with manual work or with tools, and further makes bolt mounting more convenient. Moreover, the support 2 and the light body housing 13 according to the present disclosure may further be integrally molded.

The light body portion of the outdoor lighting fixture is described in the above contents; in addition, with reference to FIG. 4, the outdoor lighting fixture further comprises a power cord 3 coupled with the light-emitting component 11 of the outdoor lighting fixture, and used for providing required electrical power for the light-emitting component 11 of the outdoor lighting fixture. Wherein, the light body housing 13 is provided with a power connection port 13*b*, and the power cord 3 is coupled with the light-emitting component 11 of the outdoor lighting fixture through the power connection port 13*b*. In order to make connection between the power cord 3 and the light body housing 13 more stably, in the present disclosure, the power cord 3 and the light body housing 13 are fixed together in a threaded fastening manner. Specifically, the power connection port 13*b* is provided with a thread, the power cord 3 is provided with a threaded fastener, and the power cord 3 and the light body housing 13 are fixed together through cooperation of the threaded fastener and the thread on the power connection port 13*b*. It should be noted that, a position of the power connection port 13*b* where the thread is provided may be determined according to the number of contact pins on the power connection port 13*b*; if there is only one contact pin, the thread may be provided on an inner wall of the power connection port 13*b*; and if there are at least two contact pins, it is necessary to provide the thread at an outer portion of the power connection port 13*b*.

It should be noted that, the light body of the outdoor lighting fixture illustrated in FIG. 4 has a shape of a rectangle, which does not constitute any limitation on the present disclosure, and the light body may have any shape of, for example, a circle, an ellipsoid, a triangle, and the like.

In sum, the outdoor lighting fixture provided by the example of the present disclosure may achieve advantageous effects below:

The light body 1 of the outdoor lighting fixture according to the present disclosure comprises the front cover 12, and the front cover 12 comprises the annular lens 122 used as a light distributing component; in the present disclosure, the employment of the annular lens 122 as a light distributing component allows light output from the annular lens 122 to have strong illumination and high brightness, thus solving the problem of low light efficiency where a reflector is used as a light distributing component.

The present disclosure provides an outdoor lighting fixture.

According to one aspect of the present disclosure, there is provided an outdoor lighting fixture, wherein a light body of the outdoor lighting fixture comprises: a light-emitting component and a front cover, the front cover comprises a front cover housing and an annular lens, and the annular lens has a light entry extremity adjacent to the light-emitting component and a light exit extremity adjacent to the front cover housing.

Optionally, the front cover housing and the annular lens are integrally molded.

Optionally, the light entry extremity of the annular lens is provided with a groove for arranging a light source in the light-emitting component.

Optionally, the light source is at least one LED chip, and the light-emitting component further comprises: a light source board and an LED driving module, wherein the LED chip is provided on the light source board, and the LED driving module is provided on the light source board, and used for driving the LED chip.

Optionally, the annular lens is ellipsoid-shaped, the groove provided at the light entry extremity of the annular lens is an ellipsoid-shaped groove, and the LED chips are distributed in the ellipsoid-shaped groove.

Optionally, the light body of the outdoor lighting fixture further comprises: a light body housing, wherein the front cover housing and the light body housing are combined to form an enclosed cavity, and the light-emitting component and the annular lens are located in the enclosed cavity.

Optionally, the light body of the outdoor lighting fixture further comprises: a sealing element, provided at a position where the front cover housing and the light body housing are combined.

Optionally, one side of the light body housing close to the front cover housing is provided with a groove for arranging the sealing element.

Optionally, the light source board is fixed onto the light body housing, or, the light source board is fixed onto the front cover housing.

Optionally, the outdoor lighting fixture further comprises: a support, provided on the light body housing.

Optionally, threaded holes are respectively provided on both sides of the light body housing, and both ends of the support are screwed to the light body housing through bolts and the threaded holes.

Optionally, both sides of the light body housing are provided with via holes in a direction perpendicular to a light projection direction of the outdoor lighting fixture, the via holes are used for closely arranging nuts, and both ends of the support are coupled to the light body housing through bolts and the nuts.

Optionally, the outdoor lighting fixture further comprises: a power cord with a waterproof joint, wherein the waterproof joint is provided thereon with a threaded fastener;

The light body housing is provided with a power connection port, the power connection port is provided with a thread that matches with the threaded fastener, and the power cord is coupled with the light-emitting component through the power connection port.

The light body of the outdoor lighting fixture according to the present disclosure comprises the front cover, and the front cover includes the annular lens as a light distributing component; in the present disclosure, the employment of the annular lens as a light distributing component allows light output from the annular lens to have strong illumination and high brightness, thus solving the problem of low light efficiency in the prior art where a reflector being used as a light distributing component.

The above description is only an overview of the technical solutions of the present disclosure, and in order that the technical solutions of the present disclosure are understood more clearly, so as to be implemented according to the contents of the specification, and the above-described and other purposes, features and advantages of the present disclosure are more obvious and understandable, specific implementation modes of the present disclosure are specifically illustrated hereinafter.

The present discloses also provides a method of manufacturing an outdoor light fixture. The method may include providing a light body of the outdoor light fixture; providing a light-emitting component and a front cover included in the light body; providing a front cover housing and an annular lens, where the annular lens has a light entry extremity adjacent to the light-emitting component and a light exit extremity coupled with the front cover housing.

The method may also include molding the front cover housing and the annular lens. The method may include providing a groove for the light entry extremity of the annular lens for arranging a light source in the light-emitting component.

The method may further include providing at least one LED chip for the light source; providing a light source board and an LED driving module included in the light-emitting component, where the LED chip is provided on the light source board, and the LED driving module is provided on the light source board, and is configured for driving the least one LED chip.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Similarly, it should be understood that, in order to streamline the present disclosure and help to understand one or more of the respective aspects, in the above description of the examples of the present disclosure, the respective features of the present disclosure are sometimes grouped together into a single example, diagram, or description thereof.

So far, it should be recognized by those skilled in the art that, although a plurality of examples of the present disclosure have been illustrated and described in detail herein, many other variations or modifications that conform to the principles of the present disclosure may still be directly determined or derived from the contents disclosed by the present disclosure without departing from the spirit and scope of the present disclosure. Therefore, the scope of the present disclosure should be understood and confirmed as covering all the other variations or modifications.

The invention claimed is:

1. An outdoor lighting fixture, comprising a light body, wherein the light body comprises: a light-emitting component and a front cover, wherein the front cover comprises a front cover housing and an annular lens, and the annular lens has a light entry extremity adjacent to the light-emitting component and a light exit extremity coupled with the front cover housing, and wherein the front cover housing and the annular lens are integrally molded, and the front cover housing is substantially rectangular-shaped while the annular lens is substantially ellipsoid-shaped;

and wherein the light exit extremity is located in a first plane, the front cover housing is located in a second plane, the light-emitting component is located in a third plane, the second plane is parallel with the third plane, the first plane is different from the second plane, and the first plane is inclined relative to the second plane.

2. The outdoor lighting fixture according to claim 1, wherein the light entry extremity of the annular lens is provided with a groove for arranging a light source in the light-emitting component.

3. The outdoor lighting fixture according to claim 2, wherein:

the light source comprises at least one LED chip, the light-emitting component further comprises: a light source board and an LED driving module, the LED chip is provided on the light source board, and the LED driving module is provided on the light source board, and is configured for driving the at least one LED chip.

4. The outdoor lighting fixture according to claim 3, wherein the groove provided at the light entry extremity of the annular lens is an ellipsoid-shaped groove, and the LED chips are distributed in the ellipsoid-shaped groove.

5. The outdoor lighting fixture according to claim 3, wherein the light body of the outdoor lighting fixture further comprises: a light body housing, wherein the front cover housing and the light body housing are combined to form an enclosed cavity, and the light-emitting component and the annular lens are in the enclosed cavity.

6. The outdoor lighting fixture according to claim 5, wherein the light body of the outdoor lighting fixture further comprises: a sealing element, and the sealing element is provided at a position where the front cover housing and the light body housing are combined.

7. The outdoor lighting fixture according to claim 6, wherein one side of the light body housing close to the front cover housing is provided with a groove for arranging the sealing element.

8. The outdoor lighting fixture according to claim 5, wherein:

the light source board is fixed onto the light body housing, or the light source board is fixed onto the front cover housing.

9. The outdoor lighting fixture according to claim 5, wherein the outdoor lighting fixture further comprises:

a support that is provided on the light body housing.

10. The outdoor lighting fixture according to claim 9, wherein threaded holes are provided on both sides of the light body housing, and both ends of the support are screwed to the light body housing through bolts and the threaded holes.

11. The outdoor lighting fixture according to claim 9, wherein: both sides of the light body housing are provided with via holes in a direction perpendicular to a light projection direction of the outdoor lighting fixture, the via holes are used for closely arranging nuts, and both ends of the support are coupled to the light body housing through bolts and the nuts.

12. The outdoor lighting fixture according to claim 9, wherein:

the outdoor lighting fixture further comprises: a power cord having a waterproof joint, wherein the waterproof joint is provided thereon with a threaded fastener;

the light body housing is provided with a power connection port, the power connection port is provided with a thread that matches with the threaded fastener, and the power cord is coupled with the light-emitting component through the power connection port.

13. A method of manufacturing an outdoor light fixture, comprising:

providing a light body of the outdoor light fixture;

providing a light-emitting component and a front cover included in the light body;

providing a front cover housing and an annular lens, wherein the annular lens has a light entry extremity adjacent to the light-emitting component and a light exit extremity coupled with the front cover housing, wherein the light exit extremity is located in a first plane, the front cover housing is located in a second plane, the light-emitting component is located in a third plane, the second plane is parallel with the third plane, the first plane is different from the second plane, and the first plane is inclined relative to the second plane, and integrally molding the front cover housing and the annular lens, wherein the front cover housing is substantially rectangular-shaped while the annular lens is substantially ellipsoid-shaped.

14. The method according to claim 13, further comprising:

providing a groove for the light entry extremity of the annular lens for arranging a light source in the light-emitting component.

15. The method according to claim 14, further comprising:

providing at least one LED chip for the light source;

providing a light source board and an LED driving module included in the light-emitting component, wherein the LED chip is provided on the light source board, and the LED driving module is provided on the light source board, and is configured for driving the least one LED chip.

* * * * *